United States Patent [19]

White

[11] Patent Number: 4,726,512

[45] Date of Patent: Feb. 23, 1988

[54] SELF-LOCKING MEANS

[76] Inventor: Clemens White, 820 Iroquois Trail, Macedonia, Ohio 44056

[21] Appl. No.: 770,234

[22] Filed: Aug. 28, 1985

[51] Int. Cl.[4] ..... B65D 91/00

[52] U.S. Cl. ..... 232/17; 232/24

[58] Field of Search ..... 232/17, 24, 45, 38, 232/33

[56] References Cited

U.S. PATENT DOCUMENTS

| | | | |
|---|---|---|---|
| 755,038 | 3/1904 | Palmer | 232/24 |
| 2,945,621 | 7/1960 | Kopprasch et al. | 232/24 |
| 4,333,603 | 6/1982 | Carlson | 232/17 |
| 4,361,271 | 11/1982 | Hester et al. | 232/17 |

FOREIGN PATENT DOCUMENTS

| | | | |
|---|---|---|---|
| 597809 | 4/1978 | Switzerland | 232/17 |

*Primary Examiner*—Robert P. Swiatek

*Attorney, Agent, or Firm*—Oldham, Oldham & Weber Co.

[57] ABSTRACT

A lock is adapted for use within a box, container or fastening wherein the lock makes the box, container or fastening freely openable for a first opening, but locked after once opened and reclosed. The lock shown in a preferred embodiment is adapted to fit within a standard rural mailbox of the type approved for use by the U.S. Postal Service wherein an inner lock box is formed within the standard mailbox by a front hinged plate operable in conjunction with movement of the front door of the mailbox and a curved top releaseable by complete closure of the mailbox door wherein such inner lock box front plate and top remain in the completely spread and open position when the mailbox is first opened (presumably by the mailman) and wherein the inner lock box front plate and top are in the closed and locked position upon the second opening of the mailbox such that a key is required to re-open the inner lock box.

3 Claims, 6 Drawing Figures

SELF-LOCKING MEANS

This invention relates to self-locking means adaptable for use within a standard Postal Authority Approved mail box of the rural delivery type. The locking means shown in its application to mail boxes to provide open access to the mailman but not to strangers, looters or thieves is easily adaptable for other security devices or needs.

In the use shown herein as mail box security means the self-locking means of the invention meets all U.S. Post Office rules and regulations for rural delivery boxes.

The mail carrier is not permitted to take any action other than opening the door of the standard box, putting in the mail and closing the door. He may not lock the box other than by simply opening and closing the door. He is not allowed to unlock the box, the door must be open when he first pulls it.

The present invention relates to a self-locking means that meets the above described needs for a rural delivery type mail box.

No Patent Office search was conducted with respect to this invention for the reason that U.S. Post Office authorities have reviewed the invention, have approved same for use within standard approved rural delivery boxes, and such authority has indicated that no such devices have hitherto been known. Copy of correspondence with the U.S. Post Office is attached hereto.

OBJECTS OF THE INVENTION

It is an object of this invention to have a means adaptable for use in standard delivery boxes to lock the mail or parcels upon delivery wherein such box is freely open to the mail or delivery man but thereafter locked to access by persons not having a key or combination.

It is an object of the invention that it meet U.S. Postal Service regulations relating to rural delivery boxes.

It is an object of the invention that all self-locking means be of durable, weather-resistant materials and incorporated into the box to be protected from the weather for longterm outdoor durability.

It is an object of the invention that the self-locking means be operable by the action of opening and closing the standard box door, without any other manipulation of any kind being required of the delivery person.

It is an object of the invention that the self-locking means be easily adjustable to a "non-lock"mode, such that the standard box may be used without the self-locking feature if desired.

It is an object of the invention that once locked a key be required for reopening the box and that such key be removable with the lock in the open or locked position.

It is an object of the invention that the self-locking means take up very little interior space within the standard box leaving it open and fully accessible to the delivery person.

It is an object of the preferred embodiment of the invention shown herein that a portion of the interior of the box remain accessible for mail or parcel delivery even when the self-locking means is in the locked position.

It is an object of the invention that the self-locking means be of a simple construction readily manufacturable for modest cost.

These and other objects and advantages to the invention shall become apparent in the following description of a preferred embodiment of the self-locking means of the invention.

DESCRIPTION OF THE INVENTION

FIG. 3 is a side view of said box.

Figure 1:
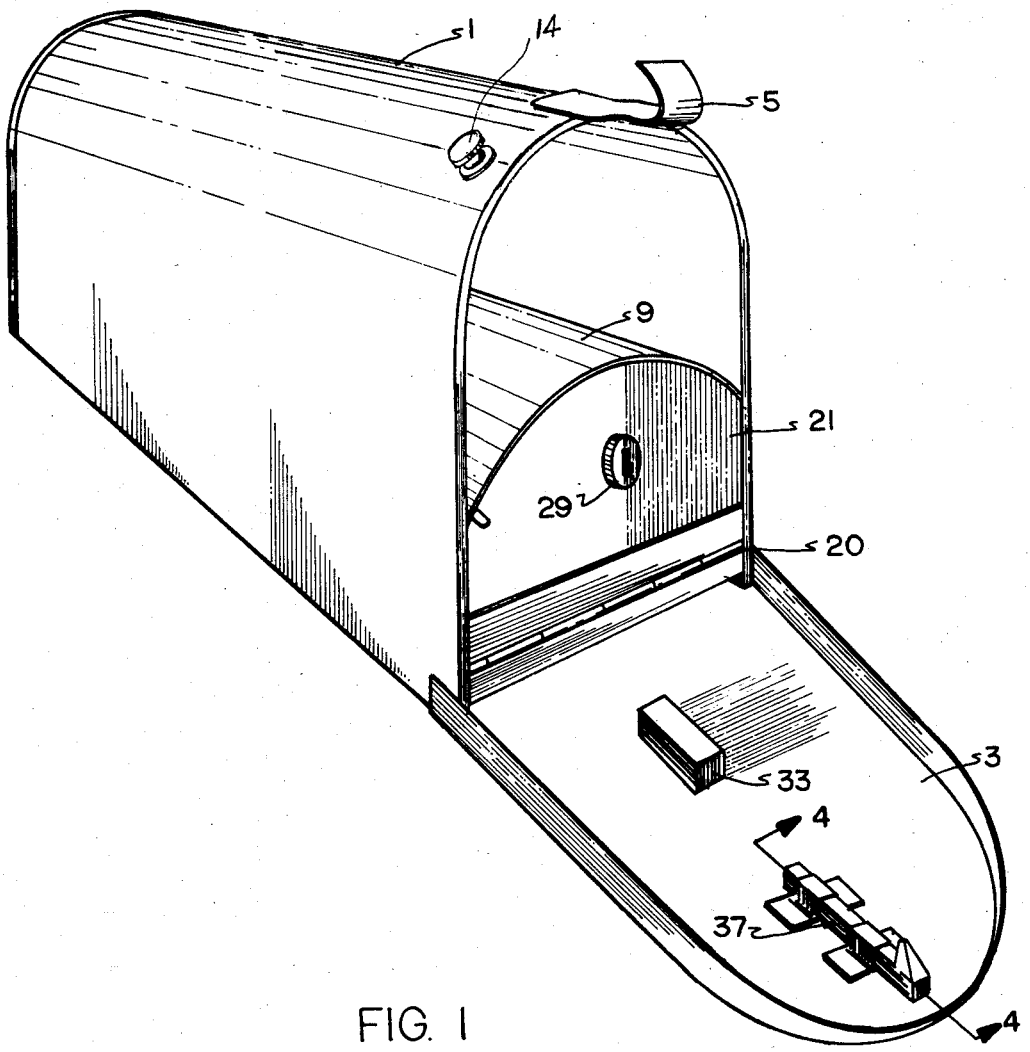
FIG. 1 is a perspective view of a standard mailbox containing the self-locking means of the invention.

Referring to the drawings more specifically, it is seen that a standard, U.S. Postal Service approved mailbox 1 is equipped generally with a front door 3. The standard door 3 is secured in an up and closed position by spring latch 5 on the top of the box and door latch 7, best seen in Fig. 3. These are standard features of an approved mailbox that are not modified by the self-locking means of the invention.

Figure 2:
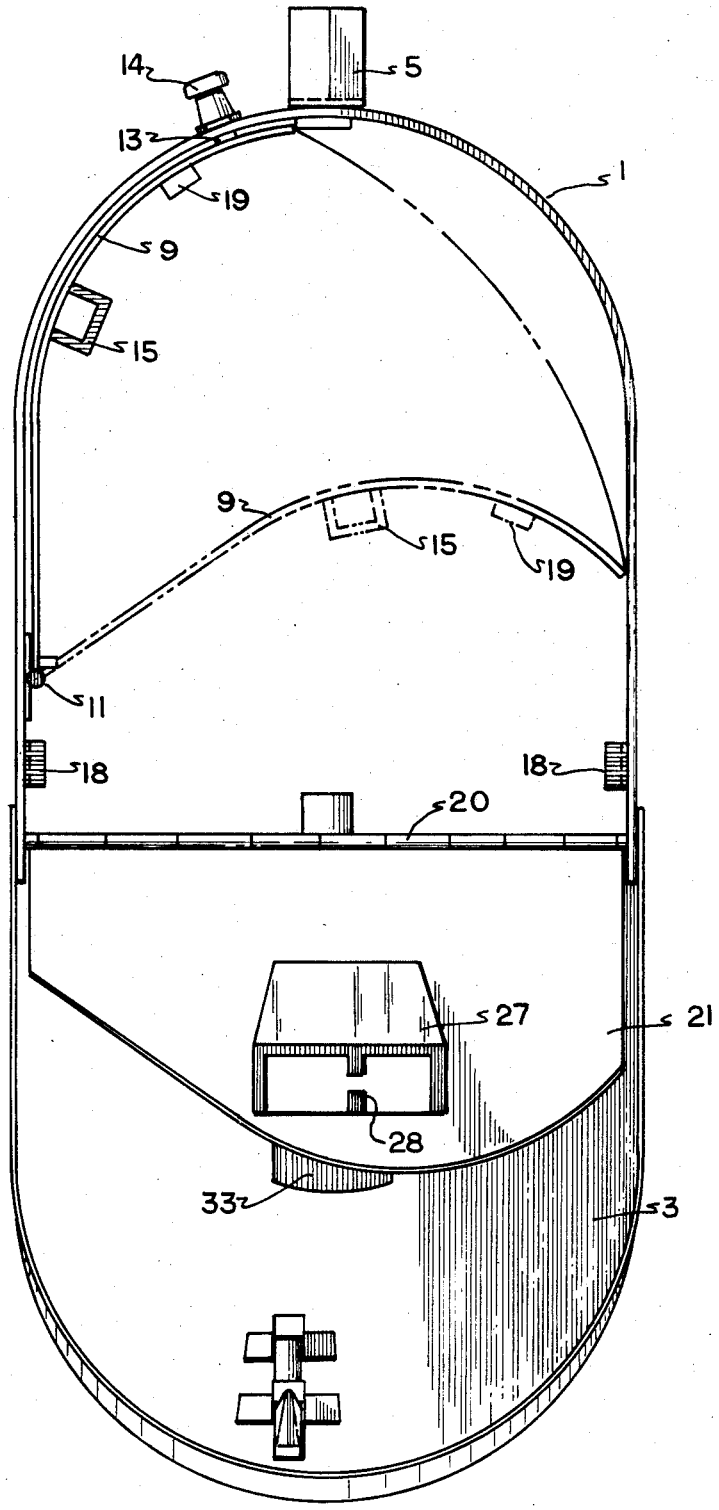
FIG. 2 is a front view of the standard box containing a slightly modified version of the self-locking means with the inner box top shown in solid line in the raised, unlocked position, and in dashed line in the lowered, locked position.
Figure 3:
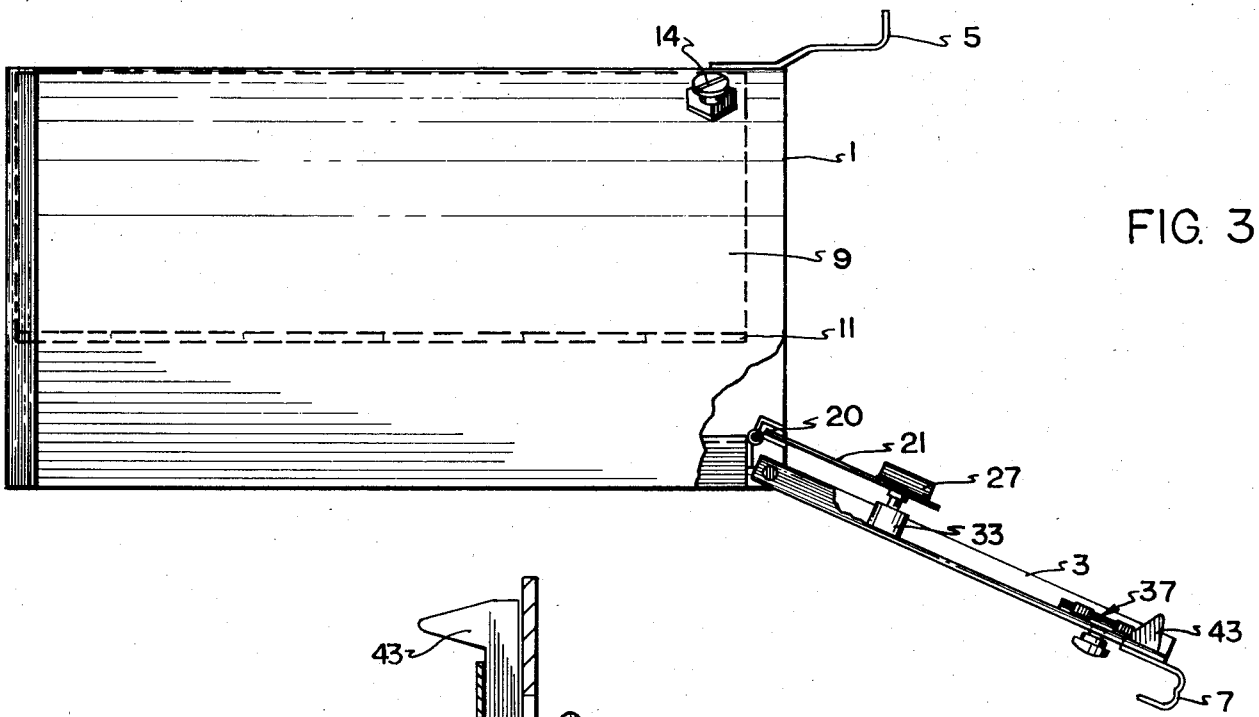
FIG. 3 is a partially cut-away view of the box shown in FIG. 2.
Figure 4:
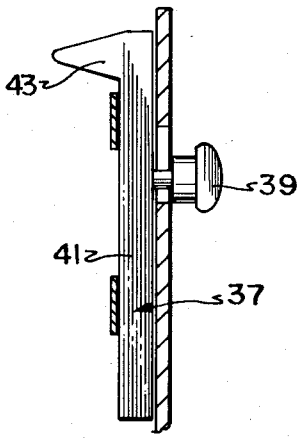
FIG. 4 is a detail view taken along line 4—4 of FIG. 1 showing the release trigger of the self-locking means of the invention.

An inner box top 9 is longitudinally pivotable along a hinge 11 seen in FIGS. 2 and 3. The top 9 is pivotable along said hinge 11 to an up and open position as shown by the solid line position of top 9 in FIG. 2. The curved configuration of top 9 allows it to nest closely against the side and top of the interior of the box 1 when in the up and open position to leave the interior of the box 1 fully open and accessible for the placement of mail or parcels therein. The top 9 is held in the up and open position by a magnet 13 mounted to the inside ceiling of the box 1 by an adjustable screw 14 extending through the top of the box 1. The adjustment screw 14 can be extended to a non-release position such that the top 9 cannot be released to fall into a locked position as will hereafter be explained. Said adjustment to prevent locking of the box is also duplicated in the release trigger 37 as will be described hereafter also and is provided as a convenience to the user of the box who may wish to "turn off" the self-locking feature at certain times.

A release trigger 37 is mounted to the inside of the front door 3. The release trigger 37 is positioned so that its trip release point 43 wedges between the top 9 and the ceiling of the box 1 when the door 3 is closed, and the top 9 is in the open position thereby prying top 9 away from its attachment to magnet 13 and allowing top 9 to fall along its hinge line 11 towards the locked position.

An inner box front plate 21 is mounted along hinge 20 parallel to the front door 3. Plunger-retraction means 33 is, in the embodiment shown, an extended magnet mounted to the inside of the front door 3. Upon closing the front door 3, said plunger-retraction means pushes inner box front plate 21 into vertical position to be locked to the top 9. If the self-locking means is not activated plunger-retraction means 33 pulls magnetically upon front plate 21 during re-opening of front door 3 to pull it to its down and open position.

Release trigger 37 is equipped with a spring mounted shaft 41 (spring not shown) and a pull knob 39. Operation of the self-locking feature of the box is accomplished by closing the front door 3 while pulling downward upon pull knob 39. This action pulls shaft 41 downward and makes trip release point 43 engage under inner box top 9 so that it does not release and the box does not lock. The door 3 is closed and the box is ready for delivery of the mail.

When the mailman comes along and opens the box, the interior space is fully accessible, he puts in the mail and closes the box. He is not allowed to take any other action, his normal action of simply reclosing front door 3 is sufficient to trigger the release of top 9 since trip release point 43 appropriately lines up to accomplish the release unless pull knob 39 is pulled down.

A spring latch unit 27 is mounted to the inside of inner box front plate 21 and it contains a spring latch 28 that engages a catch 15 mounted upon the lower side of inner box top 9.

Once the spring latch 28 is latched into catch 15 the box may only be opened by means of a key operable upon key release means 29 connected to latch 28. Key release means 29 is a standard cylinder lock with the added feature of allowing key removal when either locked or unlocked.

Pull knob 39 on the release trigger 37 is threaded and may be tightened to hold shaft 41 permanently in the lowered, non-lock position if desired. It should also be noted that a small hood could be formed over the top of pull knob 39 to protect it from ice accumulation or other problems related to extended outdoor service.

Stops 18 are attached to the inside of box 1 to prevent inner box front plate 21 from extending beyond vertical into the box 1. A small channel portion 19 is mounted to the underside of inner box top 9 to provide support upon inner box front plate 21 when in the locked position.

Figure 5:
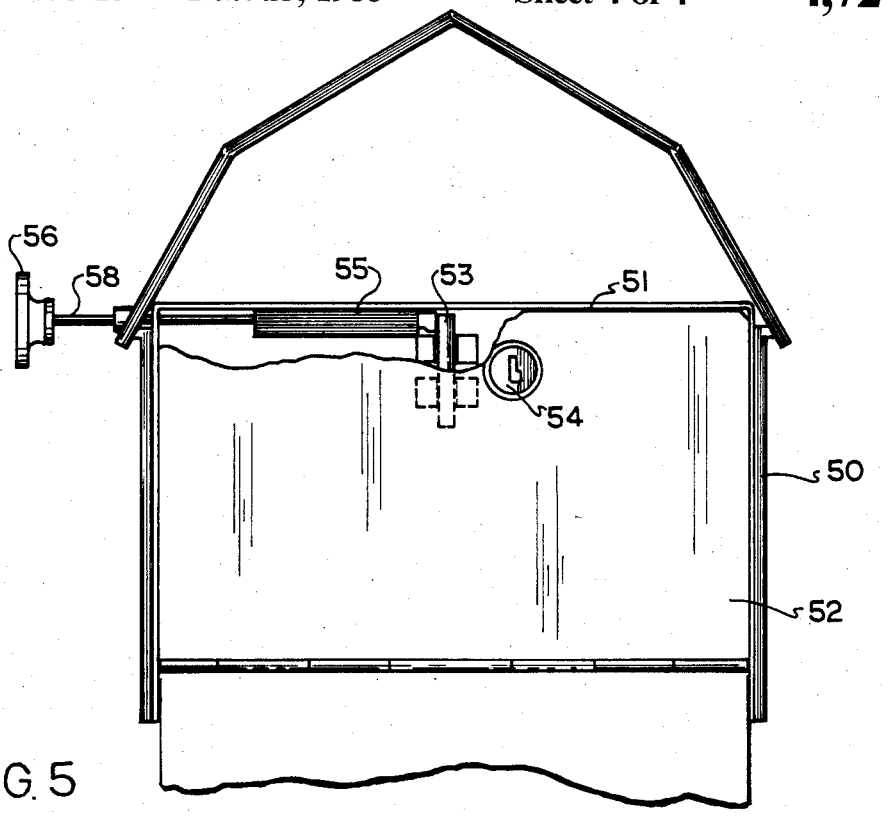
FIG. 5 is a partially cut-away front view of a modified version of the self locking means used in a different type of standard mailbox showing the latch in the non-engage position.
Figure 6:
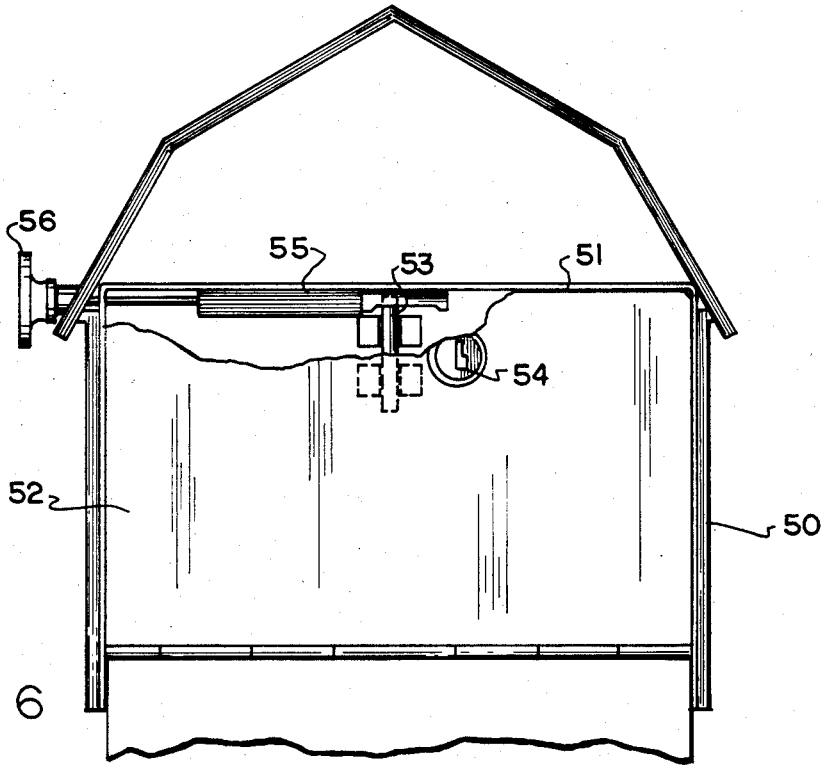
FIG. 6 is a partially cut-away front view of the box of FIG. 5 with the latch in the engage position.

A modified version of the self-locking means of the invention is shown in FIGS. 5 and 6. In this application of the self-locking means a standard mailbox 50 contains a fixed inner box 51 having a hinged inner box door 52 operable in conjunction with movement of the standard front door of the box by plunger-retraction means as previously described. A latch 53 is operable by a keyway 54 also as previously described. In this version, a catch 55 is aligned and positioned to catch and lock latch 53 upon door closure. The box may be closed in the unlocked position by pulling out upon knob 56 as shown in FIG. 5. Knob 56 is connected by shaft 58 to catch 55 such that the catch 55 is pulled away from engagement with the latch 53 when pulled out during door closing as shown in FIG. 5. Shaft 58 is spring loaded (not shown) so that opening of the door lets it move back into alignment with the catch 53 so that reclosing of the door will accomplish locking.

I claim:

1. A self-locking mailbox which comprises (a) an elongated box having an open end in a basically standard mailbox configuration;

(b) a bottom pivotable closing door on the open end;

(c) a releasable latching means to hold the door in a closed position to the box, and which is characterized by:

(d) means attached inside the box to divide the box into upper and lower essentially longitudinal horizontal compartments;

(e) a bottom pivotable second door to close the open end of one of the compartments;

(f) lock means to lock the second door in a closed position with respect to said one compartment; and (g) releasable actuating means to maintain said second door in an unlocked position; and (h) means to releasably secure the door to the second door when both doors are in the closed position whereby with the releasable actuating means maintaining the second door in an unlocked position but being actuated, opening of the door causes the second door to follow, and closure of the door closes the second door and causes the releasable actuating means to release causing the lock means to be actuated and lock the second door.

2. A mailbox according to claim 1 wherein the means attached inside the box to divide the box is a panel and the panel is positioned so as to divide the box into substantially two equal size compartments.

3. A box according to claim 2 wherein the lock means is a key operated lock.

* * * * *